US010543494B2

(12) United States Patent
Yoshida et al.

(10) Patent No.: US 10,543,494 B2
(45) Date of Patent: Jan. 28, 2020

(54) ELECTROSTATIC COATING DEVICE AND SYSTEM

(71) Applicant: Ransburg Industrial Finishing K.K., Kanagawa (JP)

(72) Inventors: Osamu Yoshida, Kanagawa (JP); Yoshiji Yokomizo, Kanagawa (JP); Naohiro Masuda, Kanagawa (JP)

(73) Assignee: Ransburg Industrial Finishing K.K., Kanagawa (JP)

( * ) Notice: Subject to any disclaimer, the term of this patent is extended or adjusted under 35 U.S.C. 154(b) by 0 days.

(21) Appl. No.: 15/199,118

(22) Filed: Jun. 30, 2016

(65) Prior Publication Data

US 2017/0001206 A1 Jan. 5, 2017

(30) Foreign Application Priority Data

Jul. 1, 2015 (JP) ..... 2015-133146

(51) Int. Cl.

| | |
|---|---|
| ***B05B 5/025*** | (2006.01) |
| ***B05C 19/04*** | (2006.01) |
| ***B05B 5/053*** | (2006.01) |
| ***B05B 5/043*** | (2006.01) |
| ***B05B 5/04*** | (2006.01) |

(52) U.S. Cl.

CPC ..... *B05B 5/025* (2013.01); *B05B 5/043* (2013.01); *B05B 5/0403* (2013.01); *B05B 5/0415* (2013.01); *B05B 5/0418* (2013.01); *B05B 5/053* (2013.01); *B05C 19/04* (2013.01)

(58) Field of Classification Search

None

See application file for complete search history.

(56) References Cited

U.S. PATENT DOCUMENTS 3,641,971 A 2/1972 Walberg
6,230,994 B1 * 5/2001 Boerner ..... B05B 3/1064 118/620

(Continued)

FOREIGN PATENT DOCUMENTS

DE 102005049234 A1 4/2006
EP 0600397 A1 6/1994

(Continued)

OTHER PUBLICATIONS

Extended European Search Report for EP Application No. 16177519.2 dated Jan. 27, 2017, 8 Pages.

(Continued)

*Primary Examiner* — Jethro M. Pence
(74) *Attorney, Agent, or Firm* — Fletcher Yoder, P.C.

(57) ABSTRACT

PROBLEM TO BE SOLVED: To evolve a spark discharge preventing effect of an electrostatic coating device.

SOLUTION: One coating robot has an arm equipped with a plurality of electrostatic coating devices 100 close to each other and the plurality of the electrostatic coating devices 100 is connected in parallel with each other to one high-voltage generator 102. A hollow rotary shaft 108 driven by an air motor 104 is disposed with nine plate-shaped resistors 120 arranged circumferentially at intervals. The nine plate-shaped resistors 120 are connected in series and a high voltage is applied via the resistors 120 to a rotary atomization head 110. The rotary atomization head 110 is made of a semiconductive resin.

9 Claims, 9 Drawing Sheets

(56) References Cited

U.S. PATENT DOCUMENTS

| | | | | | |
|---|---|---|---|---|---|
| 7,861,954 | B2 * | 1/2011 | Akisada | ..... | B05B 5/10 239/690 |
| 2006/0081729 | A1 * | 4/2006 | Nagai | ..... | B05B 5/04 239/690.1 |

FOREIGN PATENT DOCUMENTS

| | | | | | |
|---|---|---|---|---|---|
| EP | 2808090 | A1 | | 12/2014 | |
| GB | 1017859 | A | | 1/1966 | |
| JP | S58-122063 | A | * | 7/1983 | ..... B05B 5/02 |
| JP | S58-159858 | A | * | 9/1983 | ..... B05B 5/02 |
| JP | H02-298374 | A | | 12/1990 | |
| JP | H08-187453 | A | | 7/1996 | |
| JP | H10-043644 | A | | 2/1998 | |
| JP | 2000-117155 | A | | 4/2000 | |
| JP | 2004-167411 | A | | 6/2004 | |
| JP | 2010-022933 | A | | 2/2010 | |
| WO | 2012042344 | A1 | | 4/2012 | |

OTHER PUBLICATIONS

Japanese Office Action for JP Application No. 2015-133146 dated Mar. 6, 2018, 11 pgs.

* cited by examiner

ELECTROSTATIC COATING DEVICE AND SYSTEM

CROSS-REFERENCE TO RELATED APPLICATION

This application claims priority to and benefit of Japanese Patent Application No. 2015-133146 entitled "Electrostatic Coating Device and System," filed on Jul. 1, 2015, which is hereby incorporated by reference in its entirety.

BACKGROUND OF THE INVENTION

The present invention relates to an electrostatic coating device and an electrostatic coating system.

The principle of electrostatic coating is to allow charged coating particles to be electrostatically adsorbed by a workpiece. Coating materials include liquid coating materials and powder coating materials. Electrostatic coating devices for liquid coating materials are classified into two types. One type is a spray gun type, and the other type is a rotary atomization type.

An electrostatic coating device of the rotary atomization type has a rotary atomization head and scatters a coating material from an outer circumferential edge of the rotating atomization head to form fine coating particles.

The electrostatic coating devices use a direct current (DC) high voltage for negatively charging coating particles. Known systems of negatively charging coating particles include an indirect charging system applying a DC high voltage to an external electrode, a direct charging system applying a DC high voltage to the rotary atomization head, etc.

To allow the coating material discharged by a coating device to be adsorbed by a workpiece without waste, it is effective to reduce a distance between the coating device and the workpiece. However, bringing the coating device close to the workpiece causes the risk of an electric discharge between the coating device and the workpiece.

An electrostatic coating system is known that has a safety circuit for preventing occurrence of an abnormal state associated with overcurrent (Japanese Laid-Open Patent Publication Nos. 2010-22933, Hei2-298374, and Hei8-187453). The safety circuit is grounded via a bleeder resistance. The safety circuit of this type monitors a current flowing between the electrostatic coating device and a workpiece and, when overcurrent is detected, the safety circuit can interrupt the high voltage applied to the electrostatic coating device and release a residual electric charge in the electrostatic coating device via the bleeder resistance to a ground at the same time, thereby reducing the electrical potential of the electrostatic coating device to a safe level.

However, the releasing of the residual electric charge through the bleeder resistance is limited in discharge speed. In particular, when coating is performed at a short distance between the electrostatic coating device and the workpiece and the safety circuit detects an increase in high-voltage current, the electrostatic coating device tends to instantaneously discharge the accumulated charge toward the workpiece before the supply of the high voltage is interrupted and the residual electric charge is discharged to the ground at the same time by the operation of the safety circuit. A proposal for improvement in this problem is made in Japanese Laid-Open Patent Publication No. Hei8-187453. Japanese Laid-Open Patent Publication No. Hei8-187453 proposes a ring electrode disposed at a leading end of a shaping air ring so as to charge coating particles with this ring electrode.

Japanese Laid-Open Patent Publication No. 2000-117155 proposes a rotary atomization type electrostatic coating device preventing spark discharge between a workpiece and the electrostatic coating device. FIG. 9 accompanying the description of this application corresponds to FIG. 2 of Japanese Laid-Open Patent Publication No. 2000-117155. Referring to FIG. 9 accompanying the description of this application, reference numeral 200 denotes a rotary atomization type electrostatic coating device and FIG. 9 shows a front end portion of the electrostatic coating device 200. Reference numeral 202 denotes a rotary atomization head. The rotary atomization head 202 is fixed to a front end portion of a hollow rotary shaft 204. The hollow rotary shaft 204 is driven by an air motor 206. In FIG. 9, only a leading-end sleeve portion of the air motor 206 is shown.

A motor support case 208 surrounding the air motor 206 and a shaping air ring 210 attached to a leading end of the motor support case 208 are made of an insulating resin material. The air motor 206 is made of a conductive metal material. The hollow rotary shaft 204 is made of an insulating material, specifically, an insulating ceramic material. The rotary atomization head 202 is made of an insulating resin material.

The shown electrostatic coating device 200 employs a center feed system as a system for supplying a coating material to the rotary atomization head 202. In particular, a feed tube 212 is inserted in the hollow rotary shaft 204 and the coating material is supplied through the feed tube 212 to a center portion of the rotary atomization head 202. The feed tube 212 is made of an insulating resin material.

The electrostatic coating device 200 has a high-voltage generator built-in. This built-in high-voltage generator is referred to as "a cascade". The high voltage of −60 kV to −120 kV generated by the cascade is supplied to the air motor 206. A path supplying the high voltage from the air motor 206 to the rotary atomization head 202 is configured as follows.

A first semiconductive film 204*a* is formed on an outer circumferential surface of the hollow rotary shaft 204. A second semiconductive film 202*a* is formed on an outer circumferential surface of the rotary atomization head 202. The second semiconductive film 202*a* extends to an outer circumferential edge 202*b* of the rotary atomization head 202.

A gap 214 is formed between a leading end of the air motor 206 and a rear end of the rotary atomization head 202. First and second circular-arc films 216*a*, 218*a* formed on outer circumferential surfaces of first and second limiting rings 216, 218 are disposed at both axial ends of the gap 214. The first and second circular-arc films 216*a*, 218*a* are made of a semiconductive material.

A high voltage application path from the air motor 206 to the rotary atomization head 202 is made up of the first circular-arc film 216*a*, the first semiconductive film 204*a* of the hollow rotary shaft 204, the second circular-arc film 218*a*, and the second semiconductive film 202*a* of the rotary atomization head 202. The high voltage passing through this high voltage application path is supplied to an end of the second semiconductive film 202*a* of the rotary atomization head 202, i.e., the outer circumferential edge 202*b* of the rotary atomization head 202. This outer circumferential edge 202*b* acts as a discharge electrode.

According to the rotary atomization type electrostatic coating device 200 of Japanese Laid-Open Patent Publication No. 2000-117155, when the rotary atomization head 202 comes abnormally close to a workpiece, the residual electric charge in the air motor 206 made of conductive metal is dispersed by resistances of the portions 216*a*, 204*a*, 218*a*, 202*a* made up of semiconductive films. As a result, a discharge energy can be kept smaller. Additionally, even when the rotary atomization head 202 short-circuits with a workpiece, spark discharge can be prevented from occurring.

Moreover, even when the rotary atomization head 202 comes rapidly and abnormally close to a workpiece, the first limiting ring 216 disposed at the leading end side of the air motor 206 can alleviate concentration of an electric field at the leading end of the air motor 206. Similarly, the second limiting ring 218 disposed at the rear end side of the rotary atomization head 202 can alleviate concentration of an electric field at the rear end of the rotary atomization head 202.

SUMMARY OF THE INVENTION

It is an object of the present invention to provide an electrostatic coating device and an electrostatic coating system capable of evolving the spark discharge preventing effect of the electrostatic coating device without spark discharge disclosed in Japanese Laid-Open Patent Publication No. 2000-117155.

It is another object of the present invention to provide an electrostatic coating device and an electrostatic coating system capable of allowing a workpiece to be brought closer during electrostatic coating as compared to conventional ones.

FIGS. 1 to 3 are diagram for explaining a principle of the present invention. FIG. 1 depicts an embodiment of the present invention. FIG. 2 depicts another embodiment of the present invention. Referring to FIGS. 1 and 2, an electrostatic coating system 1 according to the present invention includes a high-voltage controller 2. The high-voltage controller 2 has a safety circuit 4 as in the conventional case and uses the safety circuit 4 to monitor a current flowing between an electrostatic coating device 6 and a workpiece and to reduce a high voltage applied to the electrostatic coating device 6 when detecting an overcurrent. When the electrostatic coating device 6 comes too close to a workpiece, the safety circuit 4 operates to prevent an overcurrent from flowing between the device 6 and the workpiece through voltage control.

The electrostatic coating device 6 may be of a cascade built-in type having a high-voltage generator, i.e., a cascade 8 built-in, or may be of a cascade-less type having the high-voltage generator 8 located outside. In FIG. 1 or 2, reference characters (A) and (B) are added for distinction of the cascade built-in type and the cascade-less type. FIG. 1 shows a first electrostatic coating device 6A of the cascade built-in type. FIG. 2 shows a second electrostatic coating device 6B of the cascade-less type. "LV" shown in FIGS. 1 and 2 means a low-voltage cable. "HV" in FIGS. 1 and 2 means a high-voltage cable.

Referring to FIGS. 1 and 2, a first high resistance 10 is disposed on the output side of the high-voltage generator 8. Specifically, a first resistance value R1 of the first high resistance 10 may be 80 MΩ, by way of example. The cascade with the first high resistance 10 incorporated therein is available.

The electrostatic coating device 6 has a second high resistance 12 connected in series to the first high resistance 10. A second resistance value R2 of the second high resistance 12 is larger than the first resistance value R1 of the first high resistance 10. Specifically, the second resistance value R2 of the second high resistance 12 may be 180 MΩ, by way of example. A high voltage passing through the second high resistance 12 is applied to a discharge electrode 14 like a rotary atomization head, for example. The second resistance value R2 of the second high resistance 12 is much larger than a resistance value (about 50 MΩ) of the high-voltage application path of the electrostatic coating device 200 of Japanese Laid-Open Patent Publication No. 2000-117155, i.e., referring to FIG. 9 accompanying this patent application, the first circular-arc film 216*a*, the first semiconductive film 204*a* of the hollow rotary shaft 204, the second circular-arc film 218*a*, the second semiconductive film 202*a* of the rotary atomization head 202.

The first high resistance 10 acts as a protective resistance against a disconnection accident in the electrostatic coating device 6. The second high resistance 12 has the second resistance value R2 larger than the first resistance value R1 of the first high resistance 10. Therefore, even when the discharge electrode 14 (typically exemplified by a rotary atomization head) short-circuits with a workpiece, the residual electric charge in a coating device component(s) 16 such as an air motor made of a conductive material (typically, conductive metal) can be absorbed by the second high resistance 12. As a result, the discharge energy can be made smaller as compared to the conventional cases. Referring to FIGS. 1 and 2, the electrostatic coating device 6 has the coating device component (s) 16 between the first high resistance 10 and the second high resistance 12.

Thus, the safety of the electrostatic coating device 6 can be enhanced. In other words, the electrostatic coating device 6 according to the present invention enables a coating operation performed with the electrostatic coating device 6 brought closer to a workpiece as compared to a coating distance between a conventional electrostatic coating device and a workpiece. As a result, an amount of the coating material can be reduced in terms of coating particles not adhering to the workpiece after being discharged by the electrostatic coating device 6. Therefore, the electrostatic coating device 6 according to the present invention can improve a coating efficiency by performing the coating at a closer distance from a workpiece.

Specifically, as shown in FIG. 3, the second high resistance 12 is preferably made up of multiple resistors 18. The multiple resistors 18 are connected in series. For example, when each of the resistors 18 has a resistance value r of 20 MΩ, the second high resistance 12 made up of the nine resistors 18 connected in series has the second resistance value R2 of 180 MΩ described above.

The present invention is applicable not only to a rotary atomization type electrostatic coating device using a direct charging system applying a high voltage to the rotary atomization head but also to a spray type electrostatic coating device. The coating material may be a liquid coating material or a powder coating material.

The electrostatic coating device and the electrostatic coating system of the cascade built-in type described with reference to FIG. 1 preferably use the safety circuit 4 to provide the following safety controls as in the conventional cases.

(1) Slope Sensitivity Control (Di/Dt):

For example, when electrostatic coating device rapidly approaches a workpiece and a high-voltage current abruptly changes, the high-voltage current is monitored to forcibly stop the high voltage generation if a change in value of the high-voltage current is equal to or greater than a predetermined slope sensitivity.

(2) Current Limit (CL):
When the electrostatic coating device comparatively slowly comes closer to a workpiece, the slope sensitivity control described above does not operate. An upper limit value (CL value) of the high-voltage current is set and, when a high-voltage current equal to or greater than the upper limit value is about to flow, the high voltage generation is forcibly stopped.

(3) Constant Current Control (Current Buffer: CB):
Even when a high-voltage current larger than the upper limit value (CL value) flows, constant voltage control is switched to constant current control to lower an output voltage of a high-voltage generator. This constant current control is failsafe control. When a high-voltage current having a current value larger than a predetermined current value (CB value) is about to flow, the constant current control operates to lower the output voltage of the high-voltage generator, thereby limiting the flowing high-voltage current to the predetermined current value (CB value).

In the electrostatic coating device and system of the cascade built-in type described with reference to FIG. 1, the safety is secured by the three safety control functions of (1) to (3) described above as in the conventional cases. Also in the electrostatic coating device and system of the cascade-less type described with reference to FIG. 2, the safety is secured by the three safety control functions of (1) to (3) described above.

A typical method of use of the electrostatic coating device according to the present invention is depicted in FIG. 4. The electrostatic coating device shown in FIG. 4 is the second electrostatic coating device 6B of the cascade-less type. The one external high-voltage generator 8 supplies a high voltage to the multiple second electrostatic coating devices 6B. Therefore, the multiple electrostatic coating devices 6B are connected in parallel. Although the second electrostatic coating devices 6B are shown as the electrostatic coating devices of the rotary atomization type in FIG. 4, the electrostatic coating devices may be of the spray gun type.

If the high voltage is supplied to the multiple second electrostatic coating devices (cascade-less type coating devices) 6B parallel to each other from the one high-voltage generator 8 as shown in FIG. 4, it is difficult to secure the safety functions and the prevention of damage of the high-voltage generator 8. For example, if the high-voltage generator 8 with a large capacitance is used, the high-voltage generator 8 can be prevented from being damaged. However, this coping method results in problems such as a larger size of the high-voltage generator 8, a necessity to use a resistance with large rated power for the first resistance value R1 of the first high resistance 10, and a large discharge current at the occurrence of an unexpected accident like insulation breakdown between the first high resistance 10 and the discharge electrode 202*b* (FIG. 9).

FIG. 4 shows an example of connecting the five electrostatic coating devices 6B in parallel. Reference numerals (1) to (5) are added for identification of the five second electrostatic coating devices 6B. The number of the second electrostatic coating devices 6B may be two, three, four, and six or more.

The second electrostatic coating devices 6B (of the cascade-less type) according to the present invention are preferably controlled by the high-voltage controller 2 including the safety circuit 4. The safety circuit 4 has a constant current control (current buffer) function of reducing the high voltage generated by the cascade (high-voltage generator) 8 to keep the high-voltage current constant when a high-voltage current equal to or greater than a predetermined current is about to flow. This constant current control function operates to prevent a thermal runaway damage of the cascade 8 due to a damage of the high-voltage cable HV or a ground fault of the second electrostatic coating devices 6B(1) to 6B(5), for example.

If the second coating device 6B(1) short-circuits, the constant current control CB of the safety circuit 4 (FIG. 2) is provided. Because of the constant current control, the output high voltage of the cascade (high-voltage generator) 8 is controlled such that a sum of a current $i_1$(1) of the second coating device 6B(1) and currents $i_1$(2) to $i_1$(5) between the other second coating devices 6B(2) to 6B(5) and a workpiece, i.e., $i_0$ flowing through the high-voltage cable HV, is set to a value of the constant current control. When −60 kV is applied to the second coating devices 6B(1) to 6B(5), a value of the current $i_1$ in this case is preferably 230 to 273 to in consideration of the safety.

The CB value of the constant current control limiting the current flowing though the high-voltage cable HV can arbitrary be set in consideration of the number of the multiple second coating devices 6B connected in parallel and an output capacity of the cascade (high-voltage generator) 8. Preferably, the set current value, i.e., the CB value, of the constant current control is typically set to 300 to 500 μA. The CB value is a value larger than a grounding current when one of the multiple second electrostatic coating devices 6B is grounded. From this viewpoint, for example, the sum of the first and second resistance values (R1+R2) may be 220 to 260 MΩ. The first resistance value R1 of the first high resistance 10 may be 60 to 120 MΩ, more preferably 80 to 100 MΩ, so as to effectively achieve the protective function against disconnection accident etc. in the electrostatic coating device 6. Therefore, the second resistance value R2 of the second high resistance 12 may be 100 to 200 MΩ, preferably 120 to 180 MΩ.

It is preferable that conventionally used cascade can directly be used in the electrostatic coating device and system of the cascade-less type. Additionally, when coating is performed with the coating device brought close to a workpiece, the constant current control (current buffer: CB) may be utilized to secure the safety. Preferably, this enables the prevention of damage of the high-voltage generator (cascade) 8 and the continuous coating without forcibly stopping the high voltage generation. As a result, the coating efficiency can be improved by performing the coating with the coating device brought close to the workpiece.

To set the second resistance value R2 of the second high resistance 12 to a high resistance value, the multiple resistors 18 having a plate shape is preferable in terms of incorporation of the resistors 18 into the electrostatic coating device. When the present invention is applied to the electrostatic coating device of the rotary atomization type, the multiple plate-shaped resistors 18 may be disposed on a rotary shaft coupled to the rotary atomization head. The rotary atomization head is rotationally driven by the rotary shaft. The rotary shaft typically has an outer circumferential surface with a circular cross section. The multiple plate-shaped resistors 18 may be arranged away from each other in a circumferential direction of the rotary shaft and the plate-shaped resistors 18 may be attached to the rotary shaft in a standing state from the outer circumferential surface of the hollow rotary shaft.

DETAILED DESCRIPTION OF THE PRESENT INVENTION

Figure 2:
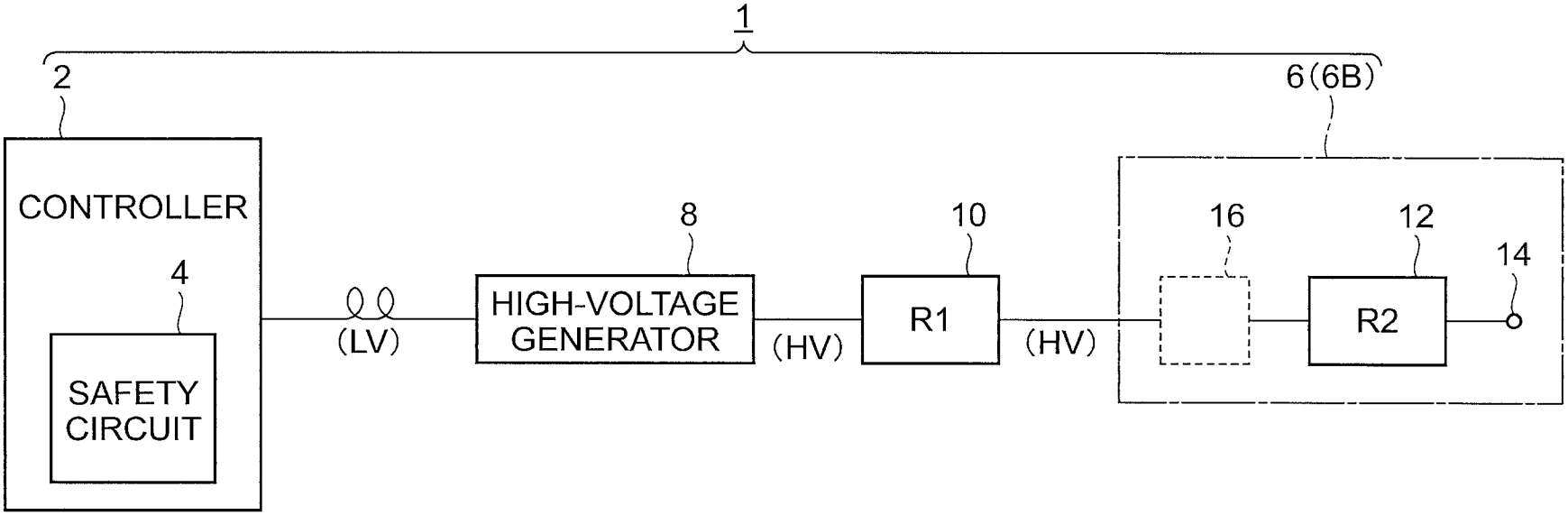
FIG. 2 shows a diagram for explaining another example according to the principle of the present invention.
Figure 3:
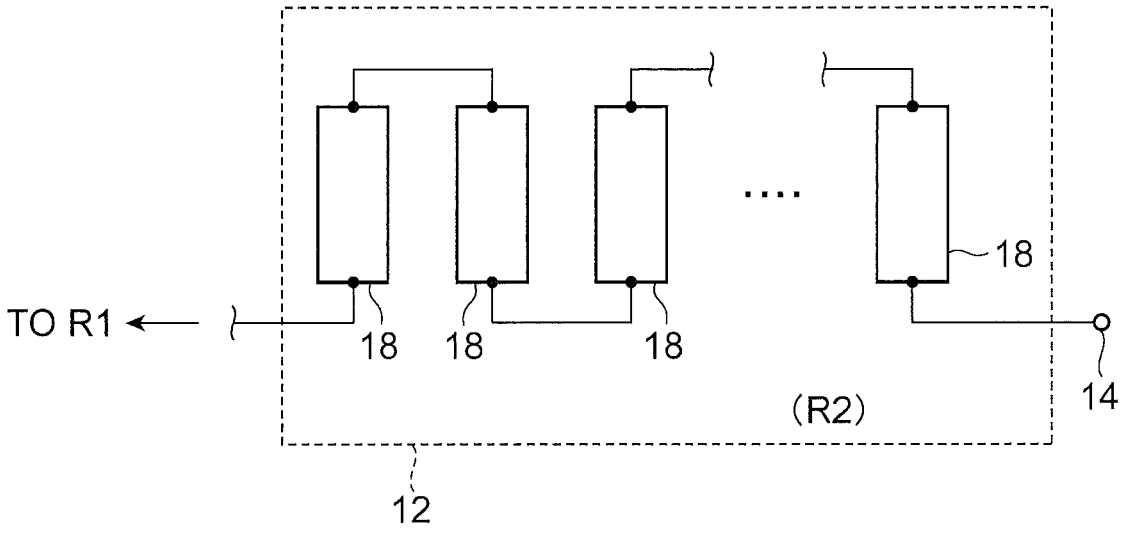
FIG. 3 shows a diagram for exemplarily explaining a specific example of a second high resistance shown in FIGS. 1 and 2.
Figure 5:
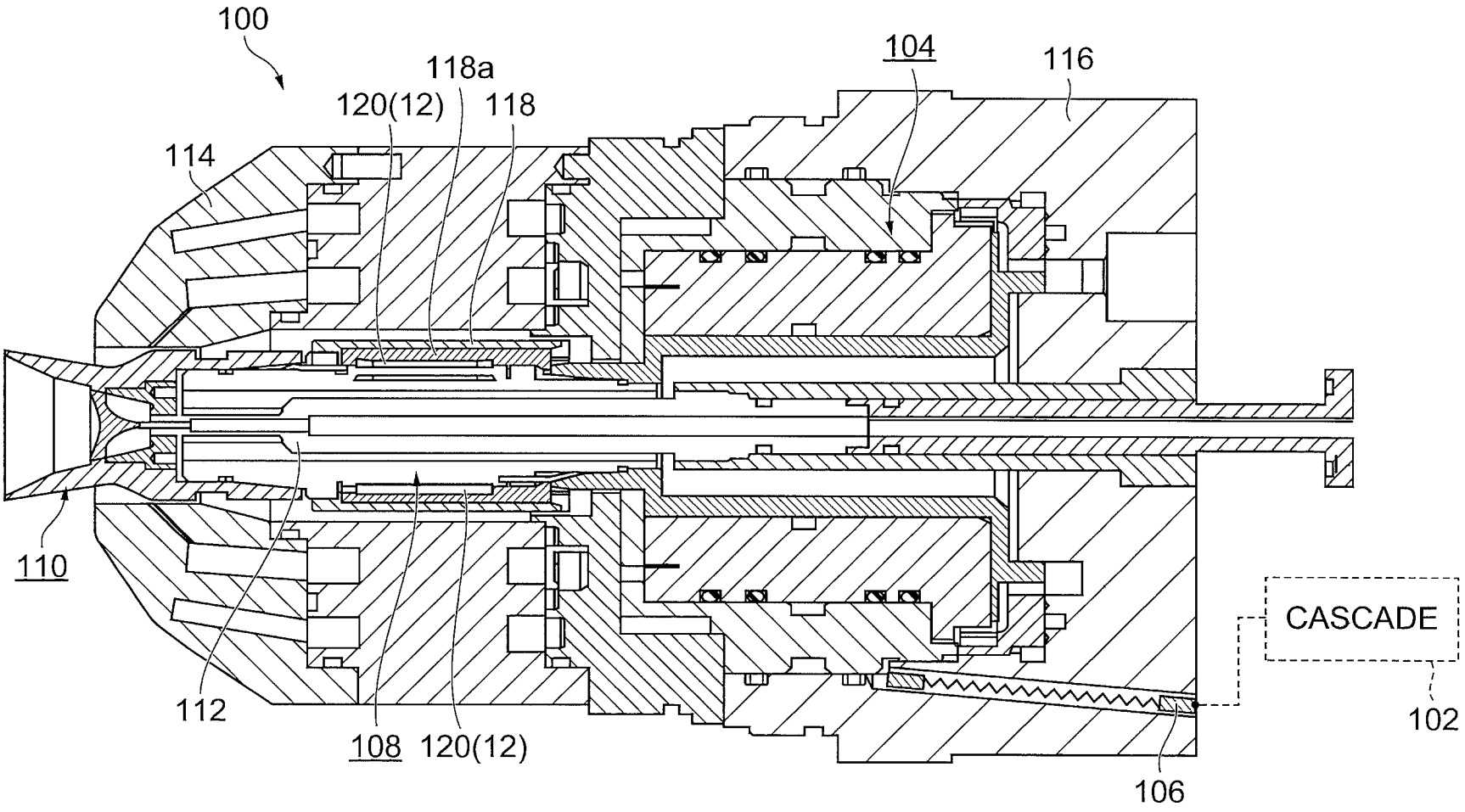
FIG. 5 shows a diagram of a cross section of a front end portion of a rotary atomization type electrostatic coating device of an embodiment according to the present invention.

FIG. 5 shows a rotary atomization type electrostatic coating device 100 of an embodiment according to the present invention. The electrostatic coating device 100 is a coating device of the cascade-less type (FIG. 2) described above. In FIG. 5, reference numeral 102 denotes a cascade. The one cascade (high-voltage generator) 102 is incorporated in a coating robot, for example. The one coating robot has an arm equipped with the multiple electrostatic coating devices 100 close to each other, and the multiple electrostatic coating devices 100 are connected in parallel with each other to the one cascade (high-voltage generator) 102.

Figure 1:
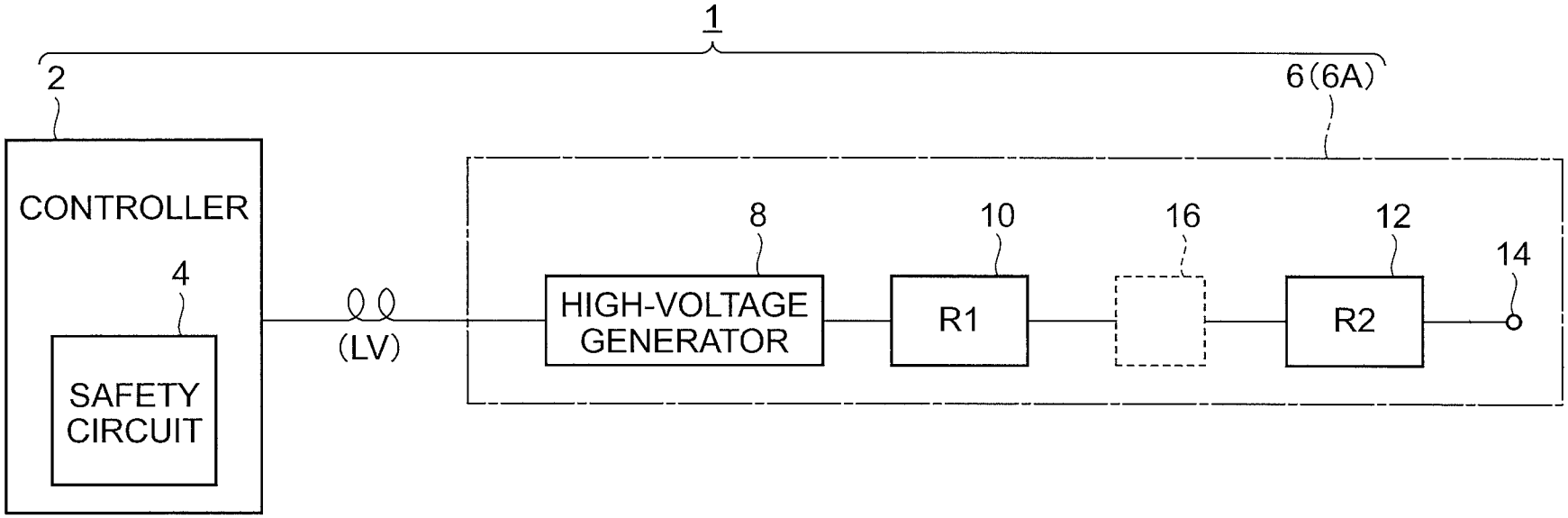
FIG. 1 shows a diagram for explaining an example according to a principle of the present invention.
Figure 4:
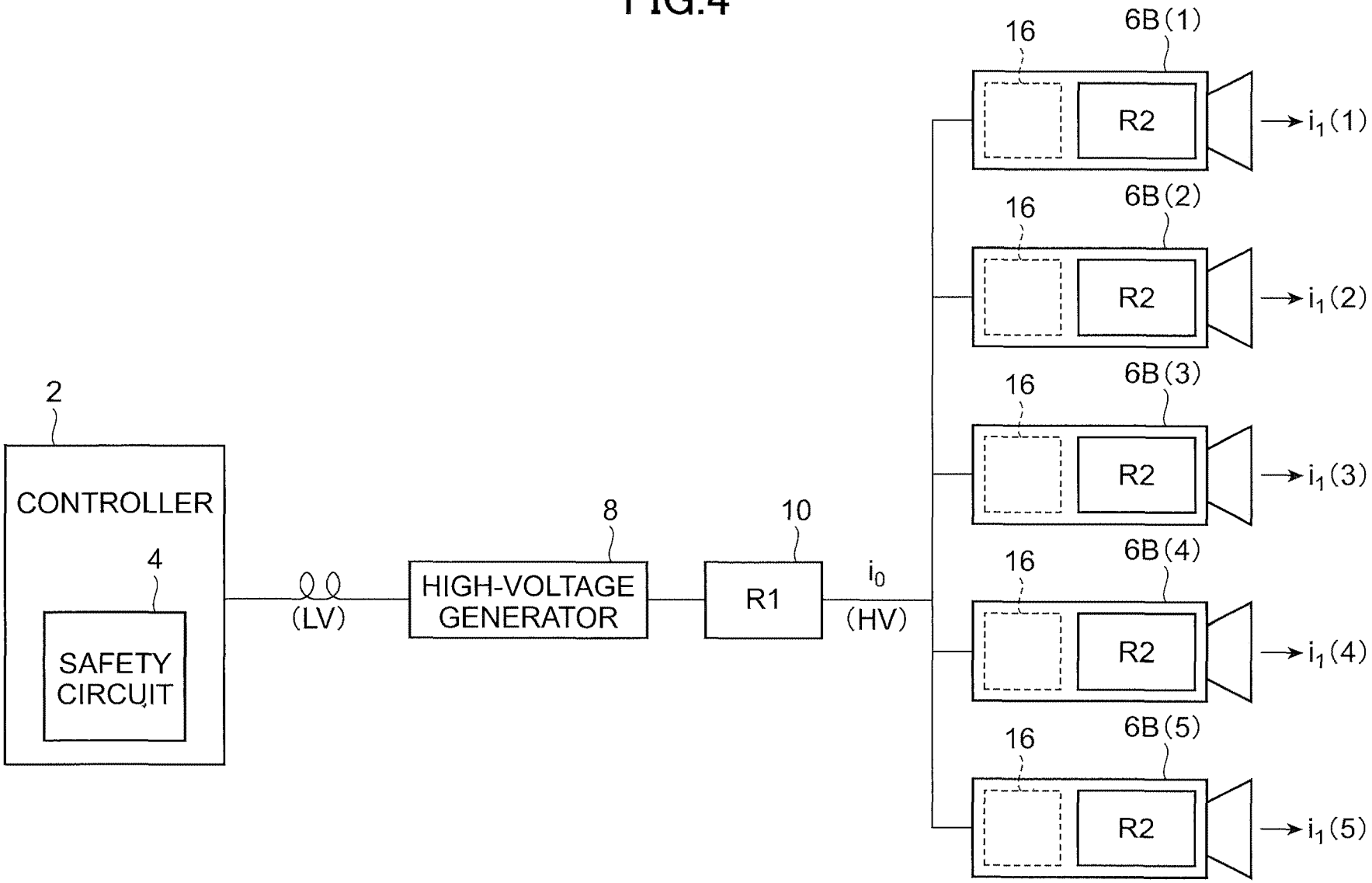
FIG. 4 shows a diagram for explaining an example of a typical method of use of an electrostatic coating device according to the present invention.

The rotary atomization type electrostatic coating device 100 is controlled by the high-voltage controller 2 as described with reference to FIG. 4 and is secured in safety by the safety circuit 4 as described above with reference to FIGS. 1, 2, and 4.

As described above with reference to FIG. 4, when multiple second electrostatic coating devices of the cascade-less type are adjacently arranged, the safety circuit 4 uses the current limit (CL) function as a backup and mainly provides the constant current control CB (current buffer) function. As described above, constant current control function is a function of reducing the high voltage output by the cascade 102 to keep the high-voltage current $i_1$ constant when the high-voltage current $i_1$ equal to or greater than a predetermined current is about to flow.

Preferably, the first high resistance 10 (FIG. 2) described above is incorporated in the cascade 102. The high voltage generated by the one cascade 102 is supplied to the multiple electrostatic coating devices 100. The first resistance value R1 of the first high resistance 10 (FIG. 2) is typically 80 M≠, and the first resistance value R1 of the first high resistance 10 (FIG. 2) of the currently available cascade 102 is 60 to 120 MΩ, preferably 80 to 100 MΩ.

Reference numeral 104 denotes an air motor. The air motor 104 is made of a conductive metal as in the conventional case. The high voltage generated by the cascade 102 is supplied via a high-voltage conductor 106 to the air motor 104. Reference numeral 108 denotes a hollow rotary shaft. The output of the air motor 104 is transmitted via the hollow rotary shaft 108 to the rotary atomization head 110.

The rotary atomization head 110 is smaller than conventional ones. The diameter of the rotary atomization head 110 is, for example, 30 mm, and may be 50 mm or less, preferably 30 to 40 mm. A feed tube 112 is disposed inside the hollow rotary shaft 108 and a liquid coating material is supplied through the feed tube 112 to the center portion of the rotary atomization head 110.

The rotary atomization head 110 is made of a semiconductive resin. A shaping air ring 114 is made of an insulating resin. The shaping air ring 114 and a motor support case 116 are connected via a relay case 118. The motor support case 116 and the relay case 118 are both made of a resin having electrically insulating characteristics.

Figure 6:
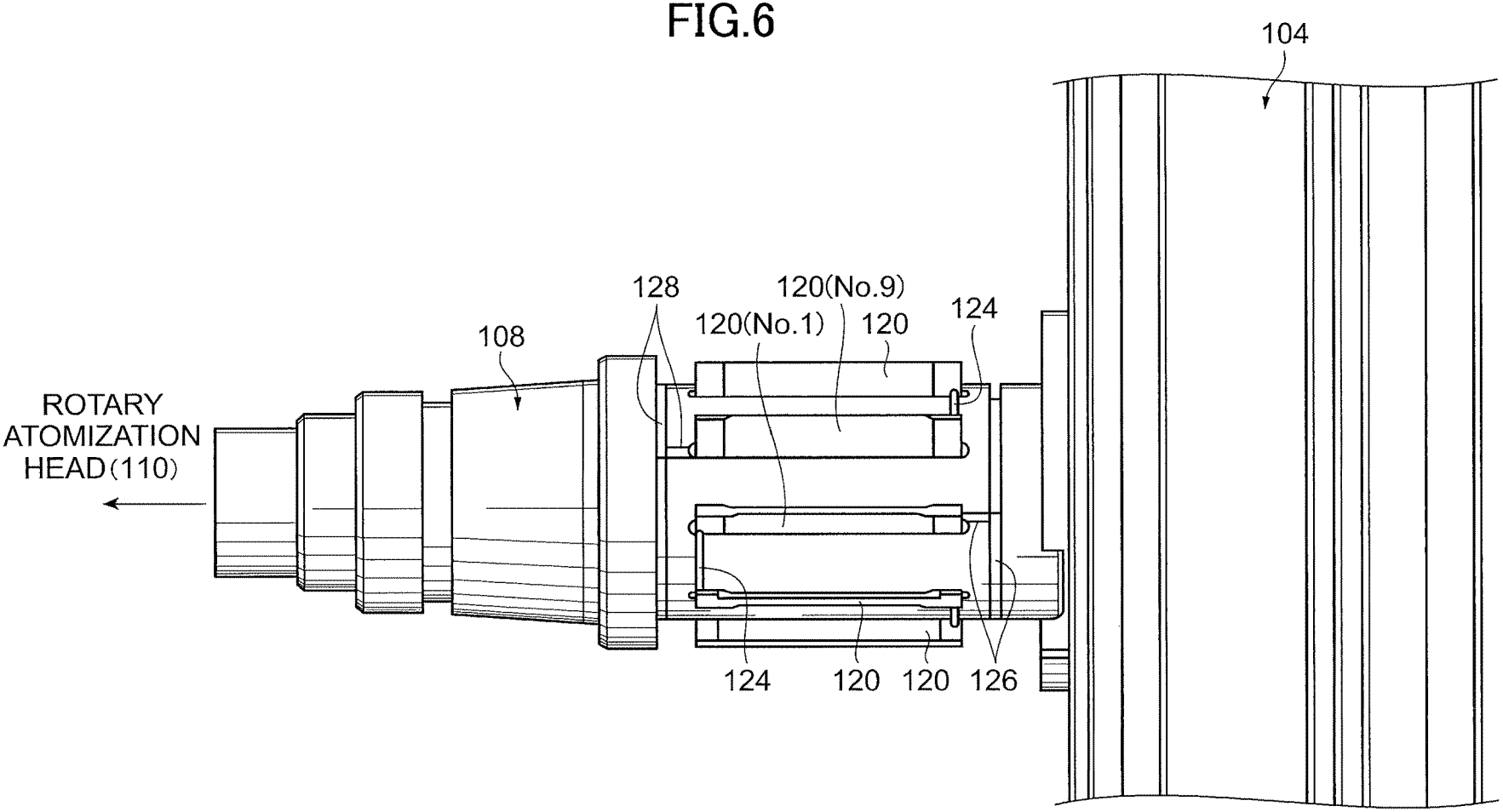
FIG. 6 shows a side view for explaining a main portion of a hollow rotary shaft included in the rotary atomization type electrostatic coating device of the example.
Figure 7:
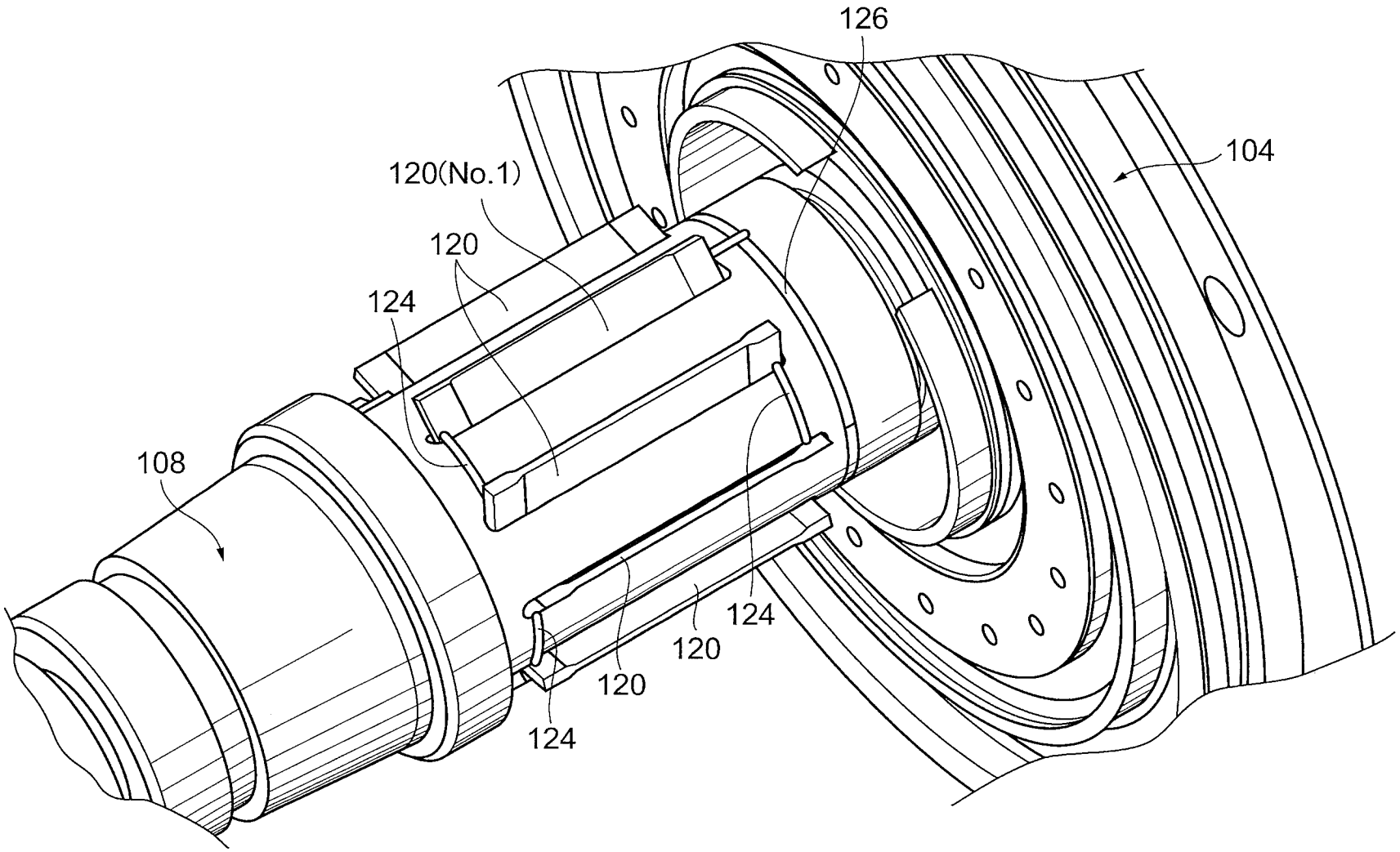
FIG. 7 shows a perspective view for explaining the main portion of the hollow rotary shaft included in the rotary atomization type electrostatic coating device of the embodiment as shown in FIG. 6.
Figure 8:
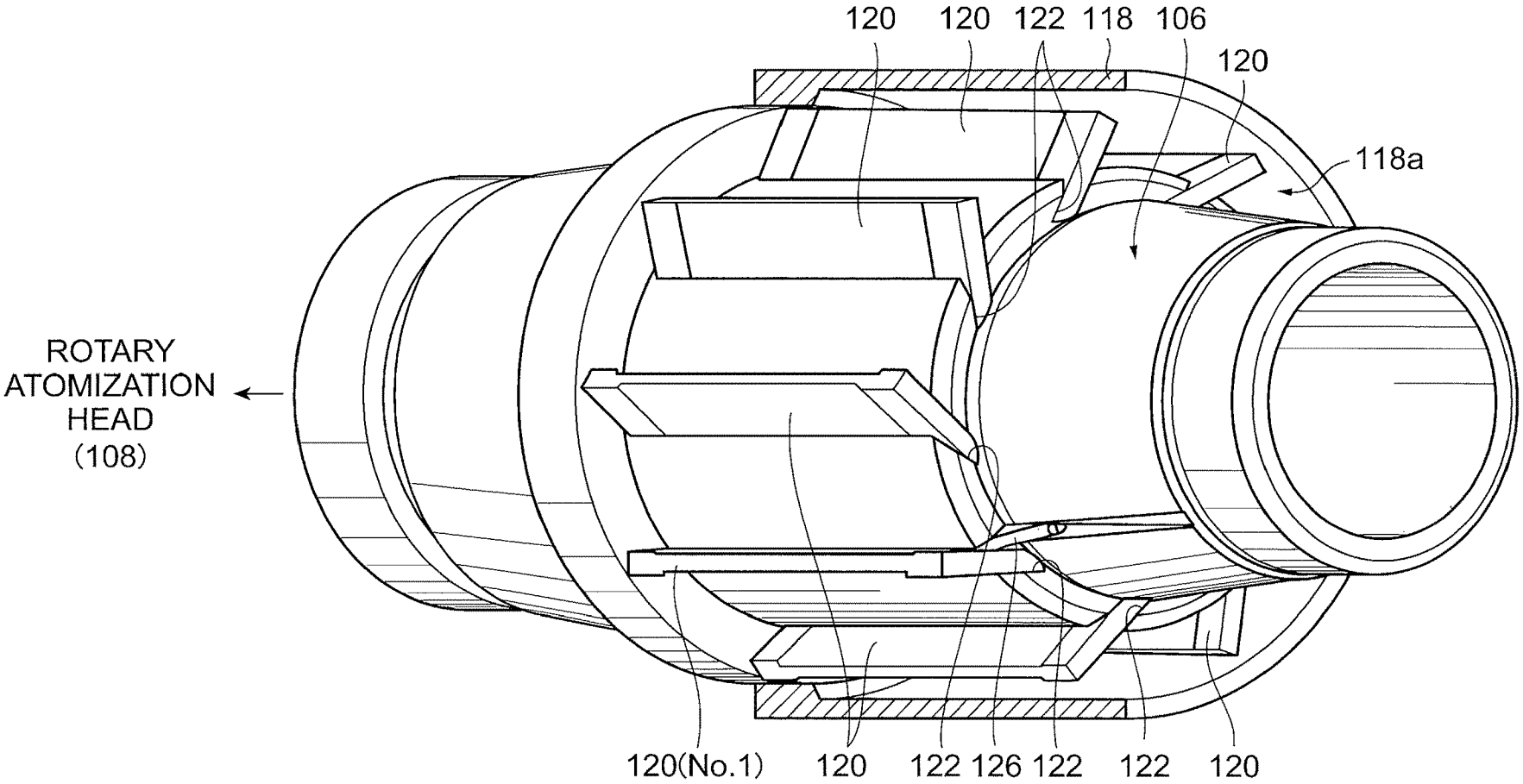
FIG. 8 shows a perspective view for explaining the main portion of the hollow rotary shaft included in the rotary atomization type electrostatic coating device of the embodiment viewed from the air motor side.
Figure 9:
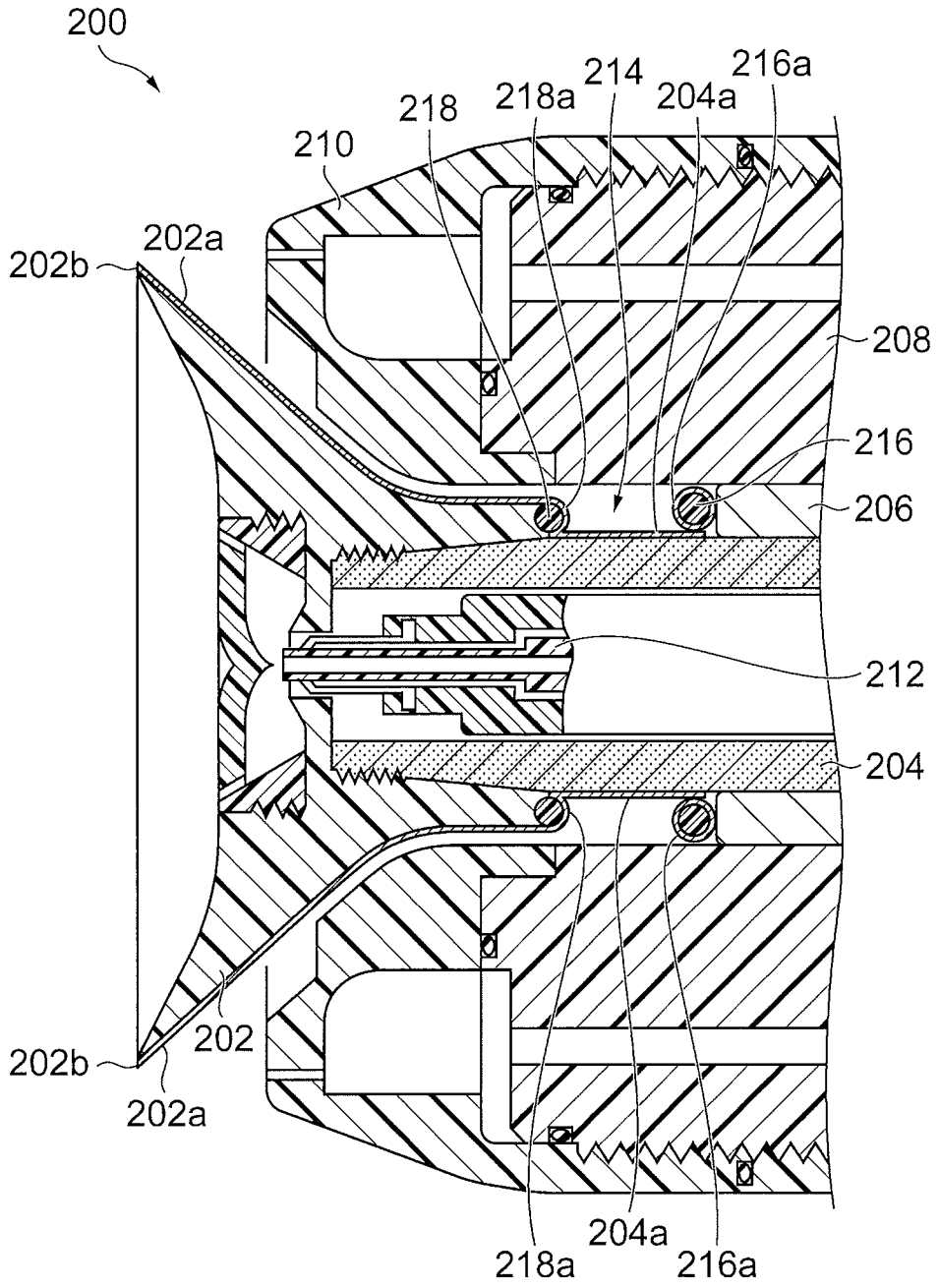
FIG. 9 shows a diagram of Japanese Laid-Open Patent Publication No. 2000-117155 corresponding to FIG. 2.

The hollow rotary shaft 108 is made of a PEEK resin (polyether ether ketone resin). The PEEK resin is excellent in electric insulation and formability. FIGS. 6 to 8 are diagrams for explaining the hollow rotary shaft 108.

FIG. 6 is a side view of a main portion of the hollow rotary shaft 108 incorporated in the air motor 104. FIG. 7 is a perspective view. FIG. 8 is a perspective view of the hollow rotary shaft 108 viewed from the air motor 104. In FIGS. 6 to 8, reference numeral 120 denotes plate-shaped resistors. The hollow rotary shaft 108 has nine grooves 122 (FIG. 8) formed on an outer circumferential surface thereof. The grooves 122 axially extend. The nine grooves 122 are circumferentially arranged at regular intervals.

The plate-shaped resistors 120 are partially fit and fixed into the respective grooves 122. The plate-shaped resistors 120 extend outward from the outer circumferential surface of the hollow rotary shaft 108. In particular, the plate-shaped resistors 120 are disposed in an obliquely standing state from the hollow rotary shaft 108. The two adjacent plate-shaped resistors 120 are connected to each other by an intermediate conducting wire 124 so that the nine plate-shaped resistors 120 are serially connected. A resistance value r of the plate-shaped resistor 120 is 20 MΩ, for example. The nine plate-shaped resistors 120 make up the second high resistance 12 (FIGS. 1 and 2) described above and the second resistance value R2 of the second high resistance 12 (FIGS. 1 and 2) is 180 MΩ.

Although nine plate-shaped resistors 120 are used in the embodiment, if the first resistance value R1 of the first high resistance 10 is 60 to 120 MΩ, the second resistance value R2 of the second high resistance 12 (FIG. 1) may be 100 to 200 MΩ. If the first resistance value R1 of the first high resistance 10 is 80 to 100 MΩ, the second resistance value R2 of the second high resistance 12 may be 120 to 180 MΩ. If the first resistance value R1 of the first high resistance 10 is 80 to 100 MΩ, the second resistance value R2 of the second high resistance 12 may preferably be 140 to 160 MΩ. The resistance value (R1+R2) acquired by summing the resistance values of the first and second high resistances 10, 12 may be 220 to 260 MΩ.

The first plate-shaped resistor 120 (No. 1) on the input side of the nine plate-shaped resistors 120 is always connected via and input-side conducting wire 126 to the air motor 104. The ninth plate-shaped resistor 120 (No. 9) located outermost on the output side is connected via an output-side conducting wire 128 to a rear end portion of the rotary atomization head 110.

A high-voltage application path from the cascade 102 to the rotary atomization head 110 is made up of the conductive air motor 104, the input-side conducting wire 126, the nine serially-connected plate-shaped resistors 120, the output-side conducting wire 128, and the rotary atomization head 110 made of a semiconductive material.

Returning to FIG. 5, a portion 118*a* surrounding the plate-shaped resistor 120 in the relay case 118 may be made by vacuum molding from a two-component epoxy resin with high electric insulation.

1 electrostatic coating system according to the present invention
6 electrostatic coating device according to the present invention
6A cascade built-in type electrostatic coating device
6B cascade-less type electrostatic coating device
8 high-voltage generator
10 first high resistance (first resistance value R1)
12 second high resistance (second resistance value R2)
14 discharge electrode
16 coating device component(s) made of conductive material
18 resistor
100 electrostatic coating device of embodiment
102 cascade
104 air motor
108 hollow rotary shaft
110 rotary atomization head of semiconductive material
120 plate-shaped resistor
122 groove
124 intermediate conducting wire
126 input-side conducting wire
128 output-side conducting wire

What is claimed is:

1. An electrostatic coating system having an electrostatic coating device configured to charge coating particles by applying to a discharge electrode a voltage generated by a voltage generator controlled by a controller, the electrostatic coating system comprising:

a first resistance;

a second resistance; and an air motor made of a conductive material between the first resistance and the second resistance, the first and second resistances and the air motor making up a voltage application path between the voltage generator and the discharge electrode;

a rotary shaft configured to transmit a rotating force of the air motor, wherein the rotary shaft is made of an electrically insulating materials, and wherein the second resistance couples directly to the rotary shaft;

wherein the first resistance and the second resistance are connected in series;

wherein the first resistance is between the voltage generator and the second resistance along the voltage application path;

wherein the second resistance is between the discharge electrode and the first resistance along the voltage application path; and wherein a resistance value of the second resistance is larger than a resistance value of the first resistance.

2. The electrostatic coating system of claim 1, wherein the electrostatic coating device is a rotary atomization type electrostatic coating device, and wherein the discharge electrode is a rotary atomization head of the rotary atomization type electrostatic coating device.

3. The electrostatic coating system of claim 2, wherein the rotary shaft is configured to transmit the rotating force of the air motor to the rotary atomization head.

4. The electrostatic coating system of claim 3, wherein the second resistance is made up of a plurality of resistors connected in series to each other, and wherein the plurality of resistors is arranged in a circumferential direction of the rotary shaft at regular intervals.

5. The electrostatic coating system of claim 4, wherein each of the plurality of resistors is plate-shaped, wherein each of the plurality of plate-shaped resistors is fit into a groove formed on an outer circumferential surface of the rotary shaft, and wherein each of the plurality of plate-shaped resistors is disposed on the rotary shaft in a standing state from the outer circumferential surface of the rotary shaft.

6. The electrostatic coating system of claim 5, wherein the rotary atomization head is made of a semiconductive material.

7. The electrostatic coating system of claim 6, wherein the rotary shaft is made up of a hollow rotary shaft made of the electrically insulating material, wherein a feed tube is disposed inside the hollow rotary shaft, and wherein a coating material is supplied through the feed tube to the rotary atomization head.

8. The electrostatic coating system of claim 1, wherein the voltage generator is incorporated in the electrostatic coating device.

9. The electrostatic coating system of claim 1, wherein the voltage generator is disposed outside the electrostatic coating device.

* * * * *